US008138435B2

(12) United States Patent
Patel et al.

(10) Patent No.: US 8,138,435 B2
(45) **Date of Patent: *Mar. 20, 2012**

(54) ELECTRICAL CONTROL DEVICE

(75) Inventors: Parimal Patel, Holbrook, NY (US); Alfred J. Lombardi, Syosset, NY (US); Danilo F. Estanislao, Old Bridge, NJ (US)

(73) Assignee: Leviton Manufacturing Company, Inc., Melville, NY (US)

( * ) Notice: Subject to any disclaimer, the term of this patent is extended or adjusted under 35 U.S.C. 154(b) by 296 days.

This patent is subject to a terminal disclaimer.

(21) Appl. No.: 12/430,718

(22) Filed: Apr. 27, 2009

(65) Prior Publication Data

US 2009/0260966 A1 Oct. 22, 2009

Related U.S. Application Data

(63) Continuation of application No. 11/694,917, filed on Mar. 30, 2007, now Pat. No. 7,538,285, and a continuation-in-part of application No. 11/559,646, filed on Nov. 14, 2006, now Pat. No. 7,756,556.

(51) Int. Cl.
*H01H 9/00* (2006.01)

(52) U.S. Cl. ..... 200/315; 200/314

(58) Field of Classification Search ..... 200/314–315, 200/317, 310–313, 339

See application file for complete search history.

(56) References Cited

U.S. PATENT DOCUMENTS

| | | | | |
|---|---|---|---|---|
| D183,395 | S | 8/1958 | Koch | |
| 3,342,967 | A | 9/1967 | Brand et al. | |
| 3,369,524 | A | 2/1968 | Fuhrer | |
| 3,706,869 | A | 12/1972 | Sorenson | |
| 4,318,684 | A | 3/1982 | Boucher | |
| 4,334,171 | A | 6/1982 | Parman et al. | |
| 4,672,229 | A | 6/1987 | Skarman et al. | |
| 4,924,151 | A | 5/1990 | D'Aleo et al. | |
| 4,939,792 | A | 7/1990 | Urbish et al. | |
| D310,819 | S | 9/1990 | Watson et al. | |
| 5,036,168 | A | 7/1991 | Kikuchi et al. | |
| 5,038,081 | A | 8/1991 | Maiale, Jr. et al. | |
| 5,059,871 | A | 10/1991 | Pearlman et al. | |
| 5,079,559 | A | 1/1992 | Umetsu et al. | |
| D323,613 | S | 2/1992 | Cummins et al. | |
| 5,101,141 | A | 3/1992 | Warner et al. | |
| 5,107,082 | A * | 4/1992 | Valenzona | 200/292 |
| D331,741 | S | 12/1992 | Fujiyoshi | |
| 5,191,265 | A | 3/1993 | D'Aleo et al. | |

(Continued)

OTHER PUBLICATIONS

International Search Report in International Application PCT/US07/77636, Dated Mar. 5, 2008, 11 pages.

(Continued)

*Primary Examiner* — Xuong Chung Trans

(74) *Attorney, Agent, or Firm* — Collard & Roe, P.C.

(57) ABSTRACT

An electrical device is disclosed for use in a wall box having a series of buttons that can either be rocker buttons or push buttons; these buttons can be supported by springboards formed integral with a support board; the springboards are for biasing the series of buttons; much of the device is housed within a housing formed at a first end by a body and a second end by a strap coupled to the housing; the strap extends beyond the body, wherein this strap can be used to dissipate heat from the device; inside of the housing can be at least one circuit board which has switches, which can be used to receive instructions from a plurality of buttons.

24 Claims, 10 Drawing Sheets

U.S. PATENT DOCUMENTS

| | | | | |
|---|---|---|---|---|
| D335,867 | S | | 5/1993 | Rowen |
| D336,894 | S | | 6/1993 | Zaretsky et al. |
| 5,225,765 | A | | 7/1993 | Callahan et al. |
| 5,239,205 | A | | 8/1993 | Hoffman et al. |
| 5,248,919 | A | | 9/1993 | Hanna et al. |
| 5,319,301 | A | | 6/1994 | Callahan et al. |
| 5,336,859 | A | | 8/1994 | Wojtanek et al. |
| 5,391,847 | A | * | 2/1995 | Gallone ..... 200/244 |
| 5,397,930 | A | | 3/1995 | Nilssen |
| 5,400,041 | A | | 3/1995 | Strickland |
| 5,430,356 | A | | 7/1995 | Ference et al. |
| 5,510,679 | A | | 4/1996 | Maiale, Jr. et al. |
| D371,123 | S | | 6/1996 | Amundsen |
| 5,530,322 | A | | 6/1996 | Ference et al. |
| 5,736,695 | A | | 4/1998 | Hoepken |
| 5,736,965 | A | | 4/1998 | Mosebrook et al. |
| D394,042 | S | | 5/1998 | Hwang |
| 5,867,127 | A | | 2/1999 | Black et al. |
| 5,898,407 | A | | 4/1999 | Paulus et al. |
| D412,492 | S | | 8/1999 | Gatchell et al. |
| D416,871 | S | | 11/1999 | Todd |
| 5,982,103 | A | | 11/1999 | Mosebrook et al. |
| 6,046,550 | A | | 4/2000 | Ference et al. |
| 6,091,205 | A | | 7/2000 | Newman, Jr. et al. |
| 6,129,440 | A | * | 10/2000 | Reynolds ..... 362/95 |
| D435,023 | S | | 12/2000 | Carson et al. |
| D440,207 | S | | 4/2001 | Carson et al. |
| 6,211,626 | B1 | | 4/2001 | Lys et al. |
| D447,123 | S | | 8/2001 | Winkler |
| 6,297,724 | B1 | | 10/2001 | Bryans et al. |
| 6,335,500 | B1 | | 1/2002 | Chi et al. |
| 6,340,868 | B1 | | 1/2002 | Lys et al. |
| 6,347,028 | B1 | | 2/2002 | Hausman, Jr. et al. |
| 6,369,524 | B1 | | 4/2002 | Sid |
| 6,380,692 | B1 | | 4/2002 | Newman, Jr. et al. |
| 6,459,919 | B1 | | 10/2002 | Lys et al. |
| 6,469,457 | B2 | | 10/2002 | Callahan |
| 6,507,158 | B1 | | 1/2003 | Wang |
| 6,528,957 | B1 | | 3/2003 | Luchaco |
| 6,685,550 | B2 | | 2/2004 | Houtz et al. |
| 6,686,550 | B2 | | 2/2004 | Seki et al. |
| 6,761,470 | B2 | | 7/2004 | Sid |
| 6,798,341 | B1 | | 9/2004 | Eckel et al. |
| 6,888,080 | B2 | * | 5/2005 | Sasaki ..... 200/339 |
| 6,901,439 | B1 | | 5/2005 | Bonasia et al. |
| 6,917,167 | B2 | | 7/2005 | Courtney et al. |
| D508,680 | S | | 8/2005 | Savicki, Jr. et al. |
| D518,793 | S | | 4/2006 | Hedderich et al. |
| D518,794 | S | | 4/2006 | Hedderich et al. |
| D518,795 | S | | 4/2006 | Sorenson |
| D519,939 | S | | 5/2006 | Hedderich et al. |
| 7,038,910 | B1 | | 5/2006 | Hodge et al. |
| 7,071,634 | B2 | | 7/2006 | Johnson et al. |
| 7,106,261 | B2 | | 9/2006 | Nagel et al. |
| 7,164,238 | B2 | | 1/2007 | Kazanov et al. |
| 7,166,970 | B2 | | 1/2007 | Johnson et al. |
| 7,170,018 | B2 | | 1/2007 | Ilkhanov |
| D537,795 | S | | 3/2007 | Chen |
| 7,190,322 | B2 | | 3/2007 | Apostolos et al. |
| 7,219,141 | B2 | | 5/2007 | Bonasia et al. |
| D563,326 | S | | 3/2008 | Patel et al. |
| D563,904 | S | | 3/2008 | Patel et al. |
| 2001/0015862 | A1 | | 8/2001 | Lynam et al. |
| 2002/0139655 | A1 | | 10/2002 | Balabon et al. |
| 2003/0076281 | A1 | | 4/2003 | Morgan et al. |
| 2003/0233129 | A1 | | 12/2003 | Matos |
| 2004/0002792 | A1 | | 1/2004 | Hoffknecht |
| 2004/0212324 | A1 | | 10/2004 | Callahan |
| 2005/0043907 | A1 | | 2/2005 | Eckel et al. |
| 2005/0125083 | A1 | | 6/2005 | Kiko |
| 2005/0225496 | A1 | | 10/2005 | Apostolos et al. |
| 2005/0248300 | A1 | | 11/2005 | Walko, Jr. et al. |
| 2005/0280598 | A1 | | 12/2005 | Webb et al. |
| 2006/0049935 | A1 | | 3/2006 | Giannopoulos et al. |
| 2006/0279236 | A1 | | 12/2006 | Johnson et al. |
| 2007/0162536 | A1 | | 7/2007 | Ostrovsky et al. |
| 2007/0227867 | A1 | | 10/2007 | Yang |
| 2007/0262259 | A1 | | 11/2007 | Wu et al. |

OTHER PUBLICATIONS

International Search Report in International Application PCT/US07/77796, Dated Mar. 14, 2008, 10 pages.

International Search Report in International Application PCT/US07/65730 Dated Feb. 7, 2008, 10 pages.

International Preliminary Report on Patentability, Date of Mailing May 28, 2009 for PCT/US2007/077636 which was filed on Sep. 5, 2007. 7 pages.

International Preliminary Report on Patentability, Date of Mailing May 28, 2009 for PCT/US2007/077796 which was filed on Sep. 6, 2007. 6 pages.

* cited by examiner

FIG. 5A
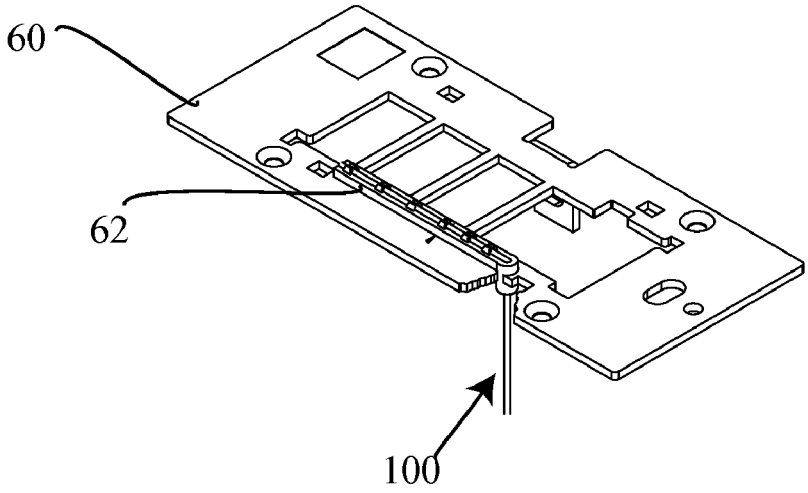
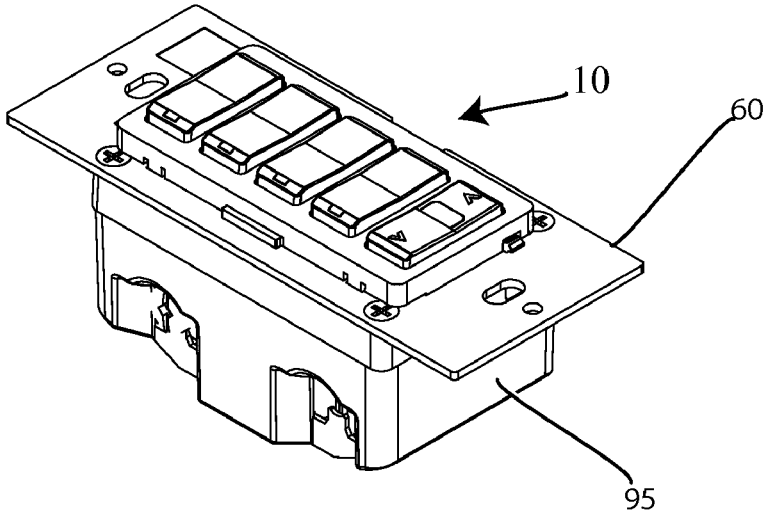
FIG. 5B

ELECTRICAL CONTROL DEVICE

CROSS REFERENCE TO RELATED APPLICATIONS

This application is a continuation of U.S. patent application Ser. No. 11/694,917 filed on Mar. 30, 2007, this application is also a continuation in part application of U.S. patent application Ser. No. 11/559,646, filed on Nov. 14, 2006, wherein the disclosure of the '917 application and the '646 application are hereby incorporated herein by reference in their entirety.

BACKGROUND OF THE INVENTION

The invention relates to a compact and efficiently designed electrical control device having buttons for allowing a user to control different electrical devices. To support these buttons, there is a spring board to bias these buttons in a particular direction.

In the past, spring boards that have been used to support either rocker mechanisms or push buttons have been made from a metallic material which may result in these spring boards being formed as separate from a support board supporting these spring boards. In addition, the use of metallic material for these spring boards can result in unnecessary interference when using an antenna enclosed within a wall mounted electrical device but disposed adjacent to these spring boards. Furthermore, previous designs of electrical devices have been cumbersome because different elements such as light pipes and buttons were not coupled together in a space saving manner.

SUMMARY OF THE INVENTION

One embodiment relates to an electrical device for use in a wall box having a series of springboards formed integral with a support board. The springboards are for biasing a series of buttons which can be in the form of either rocker buttons or push buttons. At least one of these buttons can have an associated light. While any type of light could be used, one example of a light can be in the form of a light pipe which can be used to feed light from a light emitter such as a LED light.

One of the benefits of the invention is that if a springboard is formed integral with a support board or a rack, this reduces complexity in assembly and can also reduce manufacturing cost.

If a light is incorporated into a button or switch, this can result in a more simple design and installation as well as a reduction in manufacturing and tooling costs.

The integration of the light into an associated switch or button, such as a push button or a rocker button, results in the creation of an instant indicator for these buttons.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIG. 5A discloses a perspective view of a strap and antenna wire holder shown in FIG. 1;

FIG. 5B shows a perspective view of the assembled device;

DETAILED DESCRIPTION OF PREFERRED EMBODIMENTS

Figure 1:
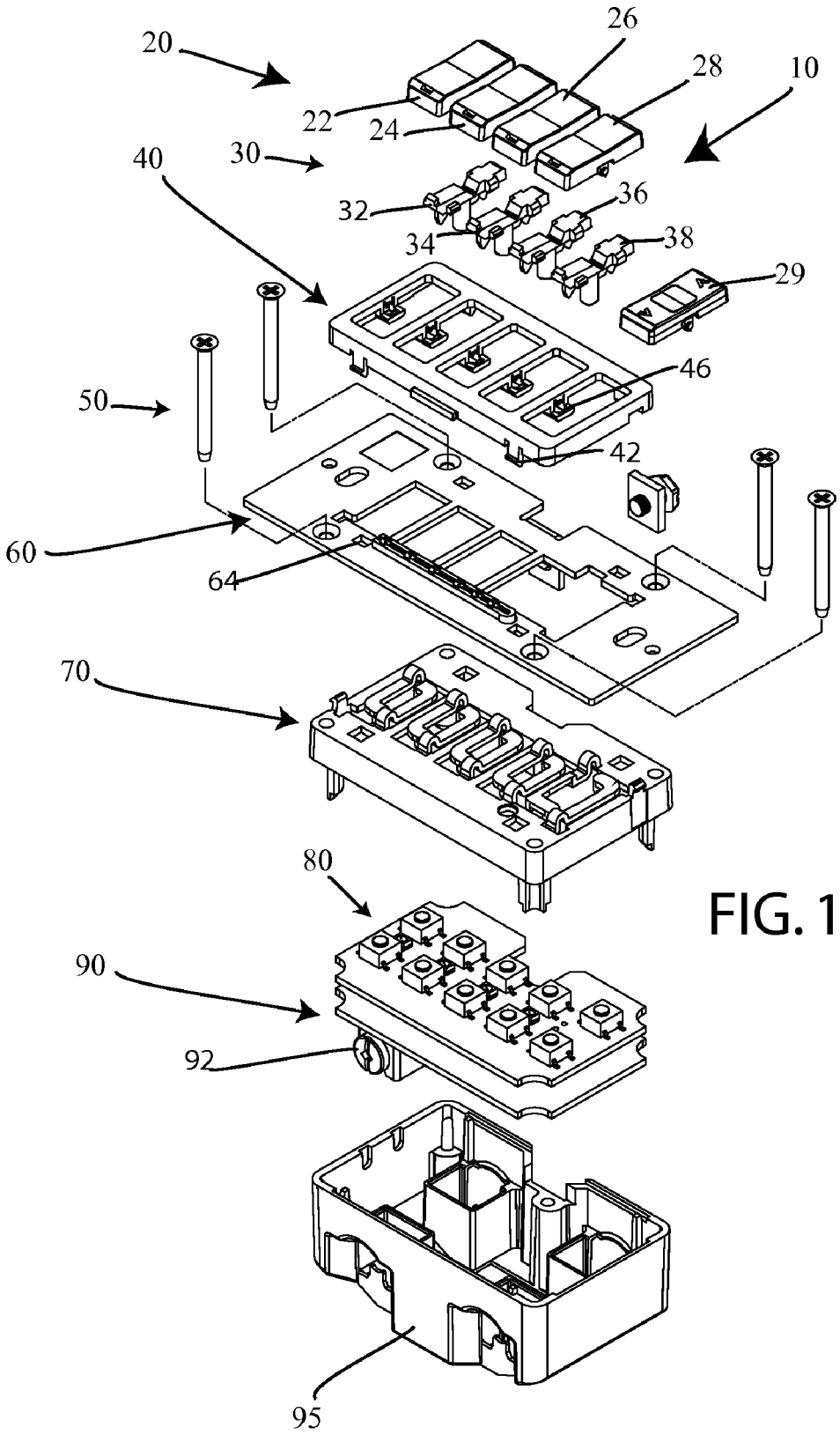
FIG. 1 discloses an exploded perspective view of a first embodiment.

Referring to the drawings, FIG. 1 discloses an exploded perspective view of the first embodiment 10. This embodiment includes a plurality of buttons 20 which can be coupled to a plurality of lights, which can be in the form of light emitting elements or light pipes 30 which can be coupled to a frame 40. Frame 40 can be coupled to strap 60 which is secured to body 95 via screws 50. Disposed below the strap 60 is a support board 70 which supports a plurality of springboards above a plurality of contacts on a circuit board 80. There is also an additional power circuit board 90 which is coupled at one end to a power input such as a contact 92 and feeds power into circuit board 80. When strap 60 is screwed into body 95, strap 60 covers support board 70, and circuit boards 80 and 90 enclosing these elements in a housing.

Figure 2A:
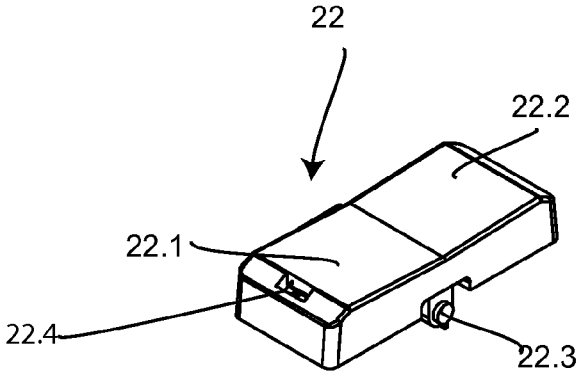
FIG. 2A is a perspective view of a button shown in FIG. 1.
Figure 2B:
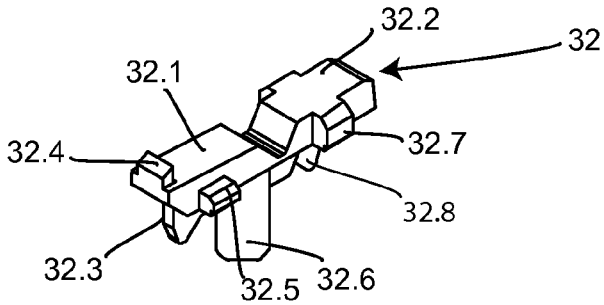
FIG. 2B discloses a perspective view of a light pipe shown in FIG. 1.
Figure 2C:
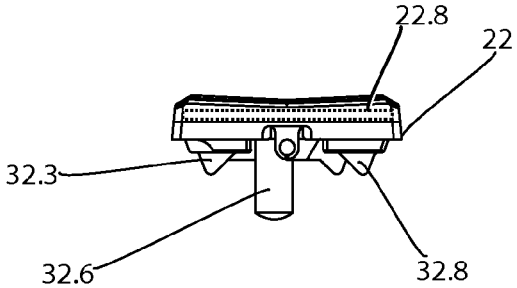
FIG. 2C shows a side view of a light pipe and button combination.

Buttons 20 can be in the form of any usable buttons but in this embodiment are shown as rocker buttons. This series of buttons includes a first button 22, a second button 24, a third button 26, and a fourth button 28. There is also an additional controller button 29 which differs from the series of buttons 20 in that this controller button 29 does not accept the light pipe. Button 22 is shown in greater detail in FIG. 2A. For example, button 22 includes a first section 22.1 which is angled, and a second section 22.2 which is angled, wherein each of these sections is joined together to form a slightly angled V-shaped button. There is a rocker hinge or axle 22.3 disposed opposite the front faces of button 22. In addition, an opening 22.4 is disposed in button 22 which is designed to allow a section of a light pipe to shine therethrough. Button 22 can also contain therein a foil strip 22.8 (See FIG. 2C) designed to block the emission of light through this button. This button 22 is designed similar to buttons 24, 26, and 28 such that these buttons all have the same components.

Figure 2D:
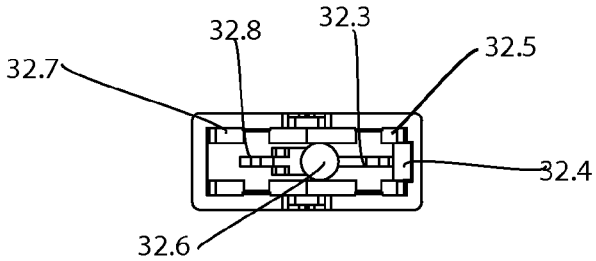
FIG. 2D shows a bottom view of a light pipe and button combination.

A series of light pipes 30 is shown as light pipes 32, 34, 36 and 38. One of these light pipes 32 is shown in greater detail in FIG. 2B. For example, light pipe 32 includes a first emitting section 32.1 and a second emitting section 32.2. Disposed between these two emitting sections is a cut out where light which extends up from a shaft 32.6 relays to either emitting section 32.1 or 32.2. Light then flows into section 32.1 and also flows into the additional components 32.3, 32.4, and 32.5. Section 32.3 acts as an actuator which then contacts an associated spring board element at the free end of this spring board element to move this spring board element down thereby contacting the associated actuator element on circuit board 80. Section 32.4 includes an extending member which extends through opening 22.4 in button 22. In this case, each light pipe has this extending section which extends through the associated opening in the associated connected button. Disposed opposite actuator 32.3 is another actuator 32.8 (See also FIGS. 2C and 2D) which extends down to contact an associated springboard when a button is pushed in that direction. There are also extending elements 32.5 and 32.7 which extend out from second emitting section 32.2. These extending elements are for snugly fitting the light pipe inside an underside region of button 22.

Figure 2E:
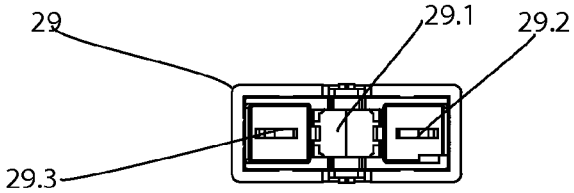
FIG. 2E shows a bottom view of another button.

FIG. 2E discloses an underside view of button 29. Button 29 is in the form of a non-lightpipe receiving button which has a translucent opening 29.1 for receiving infrared (IR) transmissions. Because button 29 does not receive a light pipe having actuators, button 29 includes its own set of actuators 29.2 and 29.3 formed therein.

Figure 3A:
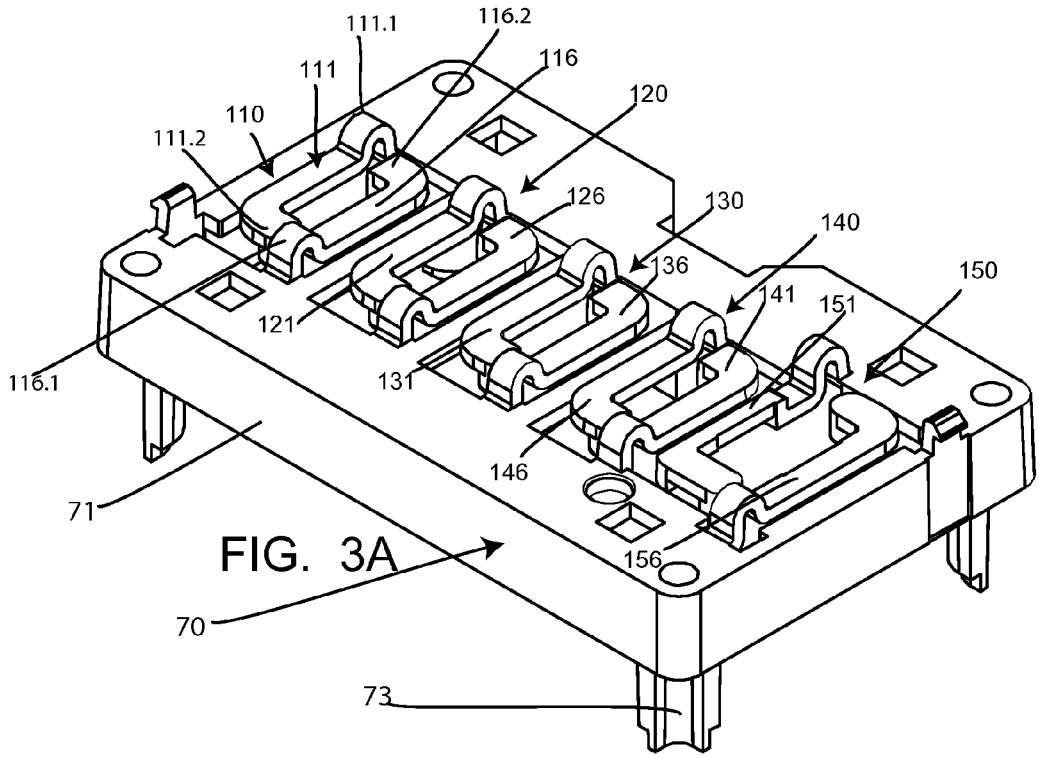
FIG. 3A discloses a perspective view of a support board shown in FIG. 1.

FIG. 3A, shows a support board 70 which includes an integral series of spring boards or associated springboard sections which are formed in a one piece manner with a frame 71. Frame 71, is supported in the housing by a series of legs 73. This frame is for supporting a series of spring board sections which in this view, includes a least two spring boards thereby allowing a rocker button to rock back and forth in at least two directions or remain at rest in the center position. For example, there is a series of springboard sections 110, 120, 130 and 140 each having at least two spring board elements. First springboard section 110 includes springboards 111 and 116. Second springboard section 120 includes springboards 121 and 126. Third springboard section 130 includes springboards 131 and 136. Fourth springboard section includes springboards 141 and 146.

While these springboard sections can be formed in any manner, and even formed different from each other, in this embodiment, each of these springboard sections are substantially identical to each other. Therefore, only first springboard section 110 will be discussed in detail. For example, first springboard section 110 includes a first springboard element 111, and a second springboard element 116 which can be used to bias the light pipe or light body section 32 into a balanced center position. By rocking button 22 either to the left or to the right, this movement causes the associated actuator elements 32.3 and 32.8 to act on the associated springboards 111 or 116. Springboard 111 includes a first section 111.1 which is formed as a molded spring section coupled to frame 71. Springboard element 111 also includes a free end 111.2 which is shown curved in a substantially L-shaped manner and extends to a free end. Pressing down on free end 111.2 causes curved section 111.1 to bend and compress thereby causing free end 111.2 to move down. This can be caused for example, by pressing down on a section of a button such as section 22.1 of button 22 which thereby presses down on the left section of a light pipe 32.1 which then presses down on associated actuator 32.3. This movement then causes free end 111.1 to move down thereby driving an actuator section 111.3 into an associated actuator on switch 182 (see FIG. 4).

Figure 3B:
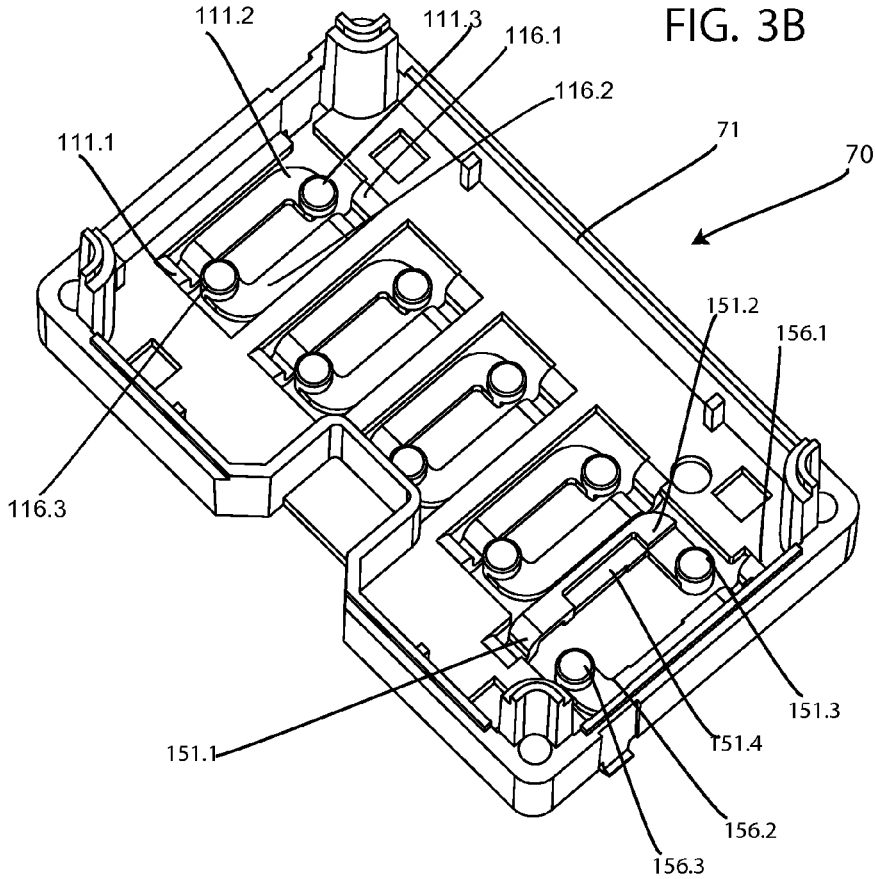
FIG. 3B shows a bottom view of the support board shown in FIG. 3A.

Springboards 151 and 156 can be formed in a similar manner to the springboards shown in springboard sections 110-140, however, in this embodiment these springboards 151 and 156 are designed differently than the springboards in springboard sections 110-140. For example, these springboards have a more pronounced L-shaped section which creates a larger spaced opening between springboards 151 and 156. In addition, as shown in FIG. 3B an underside view of springboard 151 shows a first curved flexure section 151.1 which leads to an extended region 151.2. Coupled to region of 151.2 is a contact section 151.3. Similarly, spring board 156 also includes a first curved connection section 156.1, a second free curved end 156.2 as well as a contact section 156.3. The relatively wider opening created by these springboards is designed to allow infrared light to pass therethrough.

Figure 4:
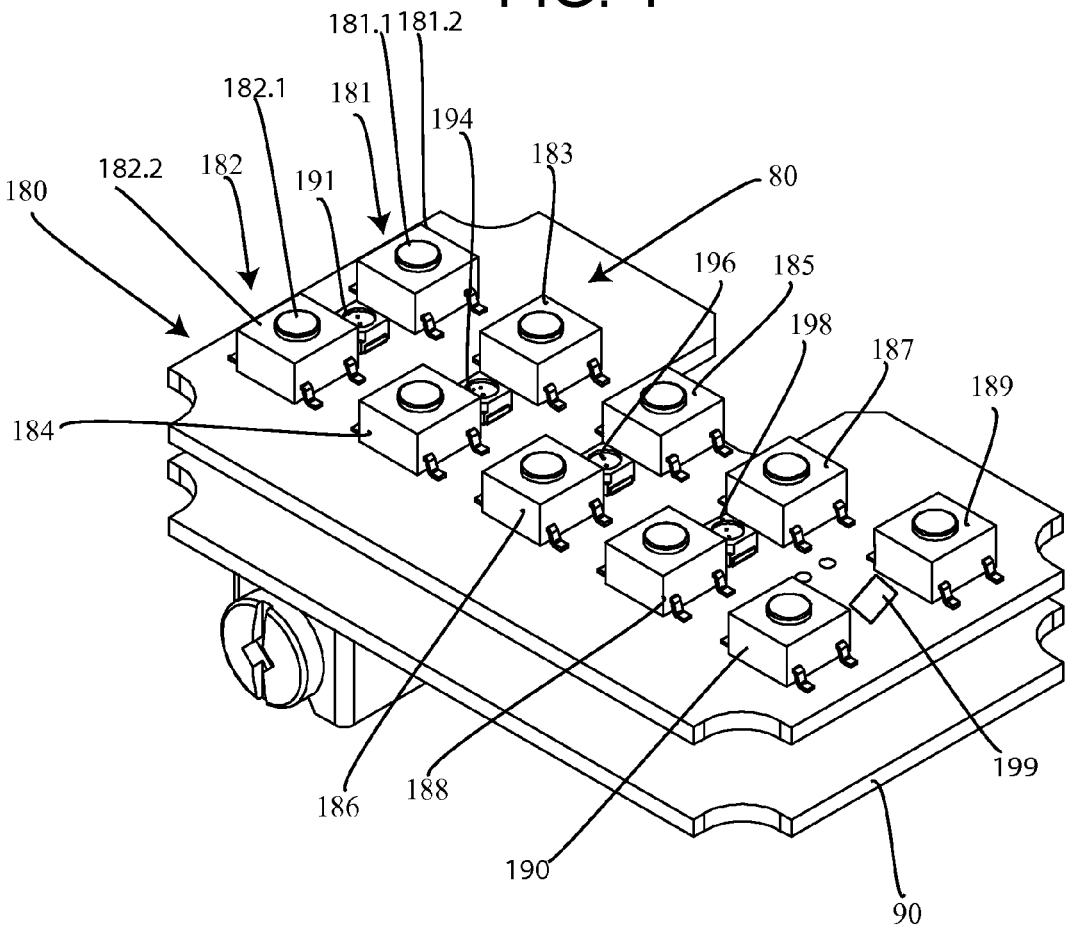
FIG. 4 shows a perspective view of a first and a second circuit board shown in FIG. 1.

These two springboards are for contacting with contacts 189 and 190 shown in FIG. 4. FIG. 4 discloses a perspective view of circuit boards 80 and 90. Circuit board 80 includes a series of switches which can be in the form of any available switches. One type of switch used could be a TAC switch. Switches 181, 182, 183, 184, 185, 186, 187, 198, 189, 190 are shown and are all disposed on circuit board 80 and adapted to work with other components on circuit board 80. Each of these switches can be formed different from each other, however in this embodiment, each of these switches are formed in a substantially similar manner. For example, switches 181 and 182 are described in greater detail, however the description of each of these switches will be sufficient to describe any of the other switches. For example switches 181, and 182 each have a switch body 181.2, and 182.2 respectively. Each of these switch bodies is fastened to circuit board 80. In addition, switch bodies and 182.2 each have associated actuator elements 181.1 or respectively.

When actuator elements 181.1 or 182.1 are contacted by an associated contact such as by contact elements 111.3 or 116.3, this sends a signal into circuit board 80 to activate a set of instructions associated with either of these switches. In addition, circuit board 80 has a series of light emitters such as light emitters 191, 194, 196, and 198. These light emitters can be in the form of a light emitting diode or LED, which can then emit light up through a light pipe such as light pipe 32 for eventual display in an associated button such as emitting through hole 22.4 in button 22.

FIG. 5A shows a perspective view of strap 60 having an antenna holder 62 coupled thereto. Antenna holders 62 can be coupled thereto as a dielectric element which can be snapped in to strap 60 thereby shielding antenna 100 from unnecessary interference with strap 60. Antenna 100 is coupled to circuit board 80 and can be fed up from circuit board 80 to antenna holder 62.

FIG. 5B shows a perspective view of the assembled device wherein strap 60 is coupled to housing 95 while antenna 100 as well as antenna holder 62 are disposed beneath a frame 40. Frame 40 can essentially be snapped into strap 60 via a series of catches 42 which can snap into associated holes 64 in strap 60. Frame 40 also contains a plurality of axle supports 46 which support associated axles such as axle 22.3. In this way, a button such as button 22 can rest on these axle supports 46 and thereby rock back and forth in frame 40. Frame 40 can be removed from strap 60 by simply pressing laterally in a forceful manner to unclip catches 42.

In this way, different colored faceplates or frames can be attached and matched with frame 40 to create a multi-changeable facade.

This type of design can be used in many different ways. One example is that this design can be used as a zone controller wherein each button 22, 24, 26, and 28 can act as an on-off switch for different lights in a room or different electrical devices in a room, or different electrical components in different rooms. A zone controller can be a user interface with multiple switches such as rocker buttons acting as on-off switches with each switch being coupled to a particular load. Since these buttons all act as rocker buttons, these buttons then can be used to separately turn on or off these different electrical components.

Figure 6:
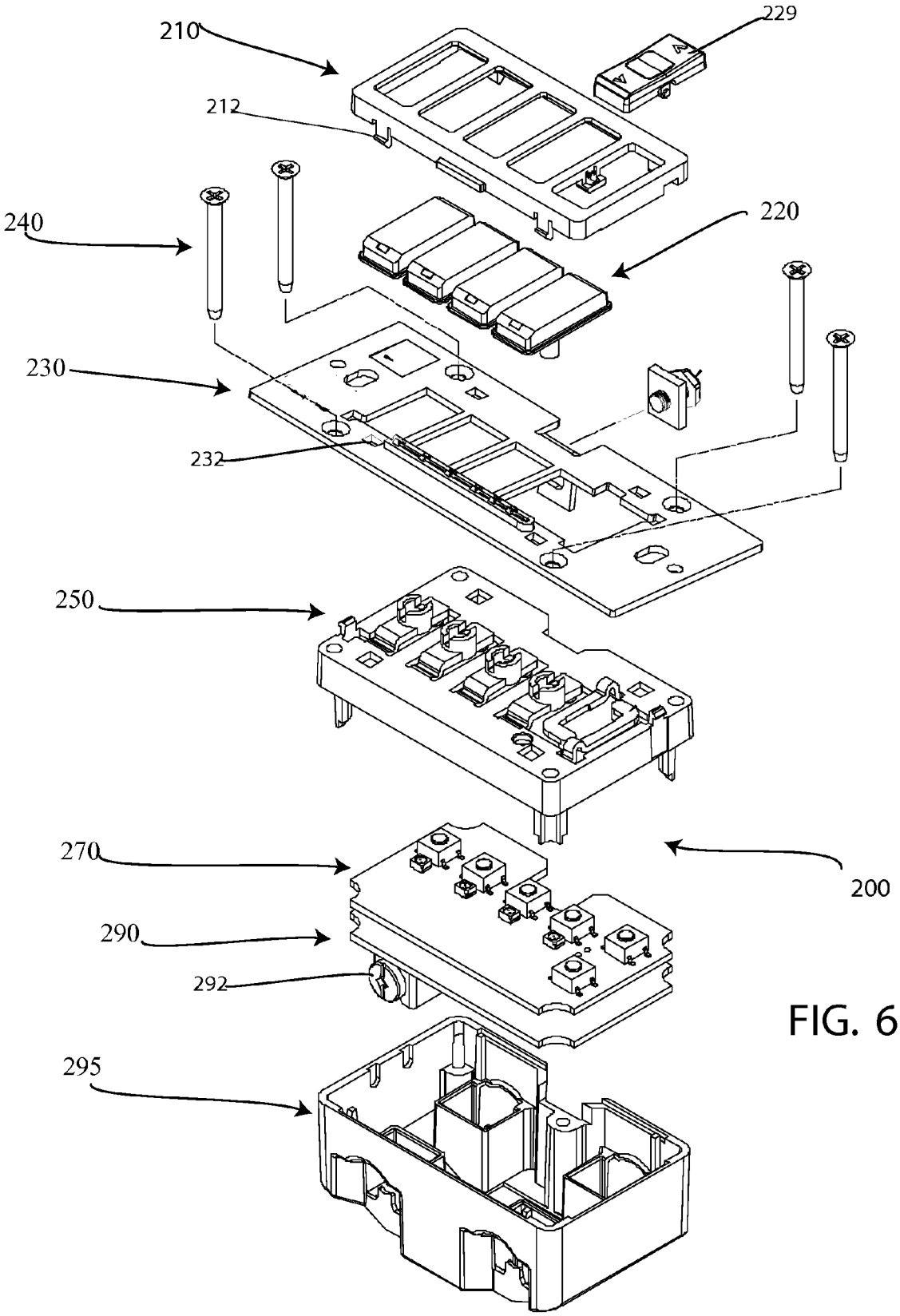
FIG. 6 is an exploded perspective view of another embodiment.

FIG. 6 discloses a perspective view of a second embodiment of the invention. This view shows face plates or frame 210 which can be used to support a plurality of buttons 220 as well as an additional rocker button 229. These buttons can be fit into the frame and an associated strap 230 wherein strap 230 can be secured to a back cover 295 via screws 240. Disposed below strap 230 is a support board 250. Support board 250 is for supporting a plurality of springboards above a plurality of associated switches on a circuit board, such as circuit boards 270 and 290. Circuit board 270 includes plurality of contacts and a plurality of light emitters. Circuit board 290 functions as a power circuit board having an associated contact 292 for receiving power from a power line and then feeds this power into circuit board 270. Once strap 230 is secured to cover 295 via screws 240, support board 250 as well as circuit boards 270 and 290 are disposed in a housing formed by back cover 295 and between strap 230 and cover 295.

Figure 7A:
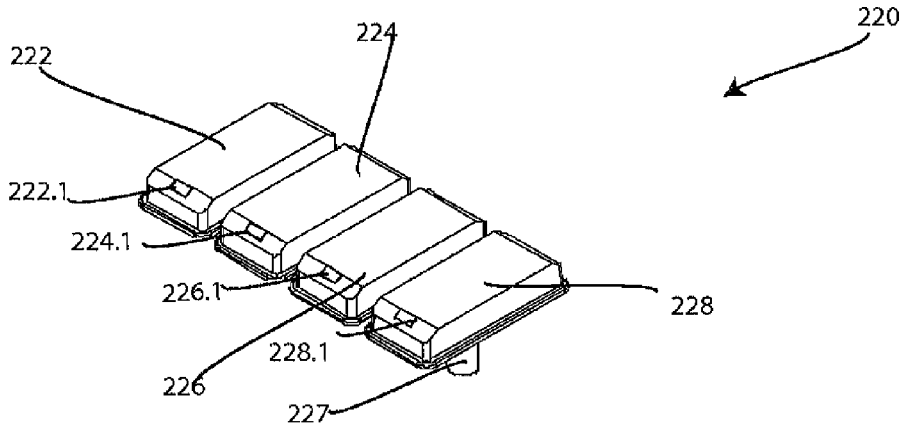
FIG. 7A is a perspective view of the series of buttons shown in FIG. 6.

FIG. 7A discloses a perspective view of button series 220. Button series 220 includes a plurality of buttons such as buttons 222, 224, 226, and 228. Each of these buttons includes an opening 222.1, 224.1, 226.1, and 228.1 respectively wherein these openings are designed to allow light to flow there-through from an associated light pipe. For example, in this view, button 228 includes a light pipe 227 coupled thereto and extending below button 228. Each of these buttons 222, 224, 226, and 228 are the form of push-buttons which can be pushed in a singular direction as opposed to rocker buttons disclosed in the previous embodiment, which can be moved in at least two different directions via a rocking motion. In this case, there can also be a design that includes different combinations of push buttons and rocker buttons as well.

Figure 7B:
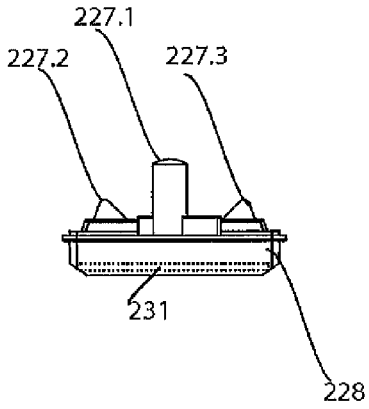
FIG. 7B is a side view of a button and lightpipe combination.
Figure 7C:
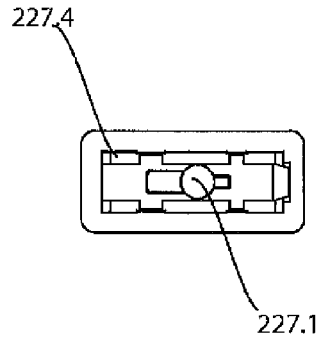
FIG. 7C is a bottom view of a button and lightpipe combination.

FIG. 7B is a side view of a button and lightpipe combination. These lightpipes are similar to the lightpipe 32 disclosed above. For example, lightpipe 227 includes a shaft 227.1, actuator elements 227.2 and 227.3 as well as extending elements 227.4 (See FIG. 7C) which allow this lightpipe to be snapped into button 228. In addition, disposed inside of this button is a strip of foil 231 which is shown by the dotted line. This strip of foil is designed to keep light from flowing out of button 228, and instead out of hole 228.1. FIG. 7C is a bottom view of button 228 and the associated lightpipe 227 showing shaft 227.1 and extending elements 227.4.

Figure 7D:
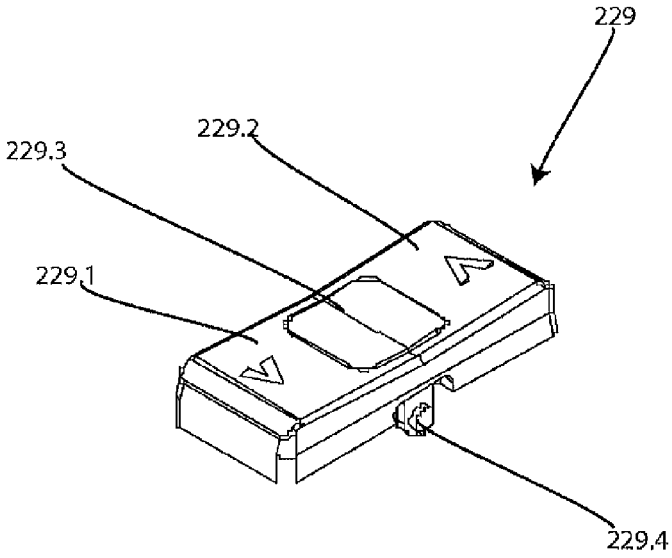
FIG. 7D is a front perspective view of an additional button shown in FIG. 6.

FIG. 7D shows button 229 is in the form of a rocker button. Rocker button 229 includes a first section 229.1, and a second section 229.2 wherein each of these sections angles up in a substantially V-shaped manner. There can be an optional third section 229.3 which is in the form of a window for receiving IR signals into the housing. These IR signals can then be received by an IR receiver 299 coupled to circuit board 270. In addition, a support forming a hinge 229.4 is coupled to the side opposite the face of this rocker button. This hinge allows this button to move back and forth to activate two different actuators disposed on circuit board 270.

Figure 8A:
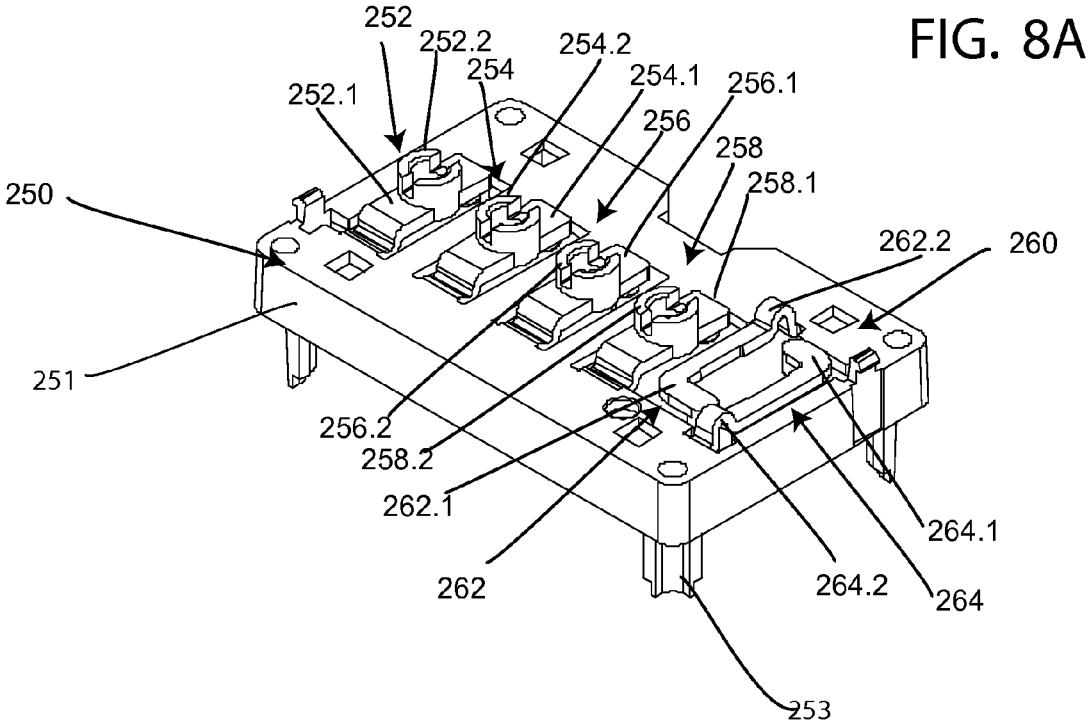
FIG. 8A is a perspective view of the support board shown in FIG. 6.

FIG. 8A discloses a perspective view of support board or frame 250 which supports a plurality of springboards coupled thereto. For example, a series of springboards 252, 254, 256, and 258 are all each coupled to frame 251 or support board 250. Support board 250 includes a frame 251 and legs 253. These legs 253 support this support board above the adjacent circuit boards. These springboards can be formed in any useful manner and may be formed differently from each other. In this embodiment, springboard 252 is substantially identical to springboards 254, 256, and 258. Therefore the description of springboard 252 applies to these other boards 254-258.

For example, spring board 252 (See FIG. 8B) includes a base section 252.1 which connects at a first end to main body 251. At this connection end is a curved section which forms an associated spring region such as a leaf spring. This section is curved because it provides greater flexure for the device by having a longer top surface area in tension than the underside in compression.

Spring board 252 has an opposite free end 252.3 which is movable when pressed on. At a central region of spring board 252, is a support column 252.2 which has an associated hole. Support column 252 is designed to receive an associated light pipe such as light pipe 227 which fits therein and extends into an associated light emitter.

Figure 8B:
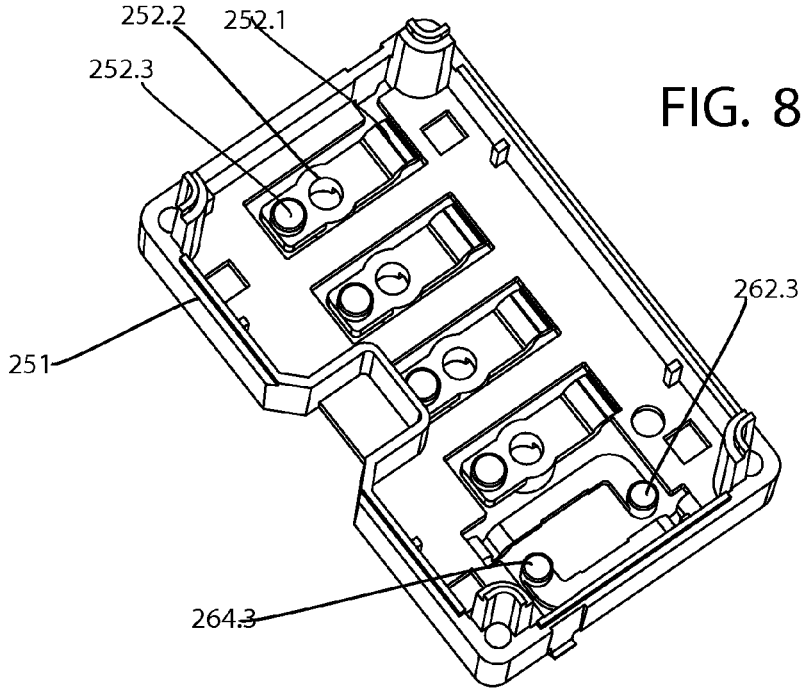
FIG. 8B is a back perspective view of the support board shown in FIG. 8A.

As shown in FIG. 8B, the free end of spring board 252 includes a contact element or button 252.4. This contact button can be used to contact an associated actuator on a switch on a circuit board 270.

A set of rocker springboards 260 is also coupled to support board 250. For example, first rocker springboard 262 includes a first connected end 262.1 and a second free end 262.2. First connected end 262.1 has a curved section which allows this springboard to form a high quality leaf spring thereby flexing and bending back up to support an associated rocker button. There is also an additional spring board 264 which is formed as a complementary springboard, to support an associated rocker button such as rocker button 229. Springboard 264 includes a first connected section 264.1 which is formed in a curved manner thereby creating a flexing leaf spring wherein this springboard also has an associated free end 264.2. FIG. 8B shows the opposite sides of these spring boards showing associated contact elements 262.3 and 264.3 which can be used to selectively contact actuators 280.1 and 282.1 (See FIG. 9).

Figure 9:
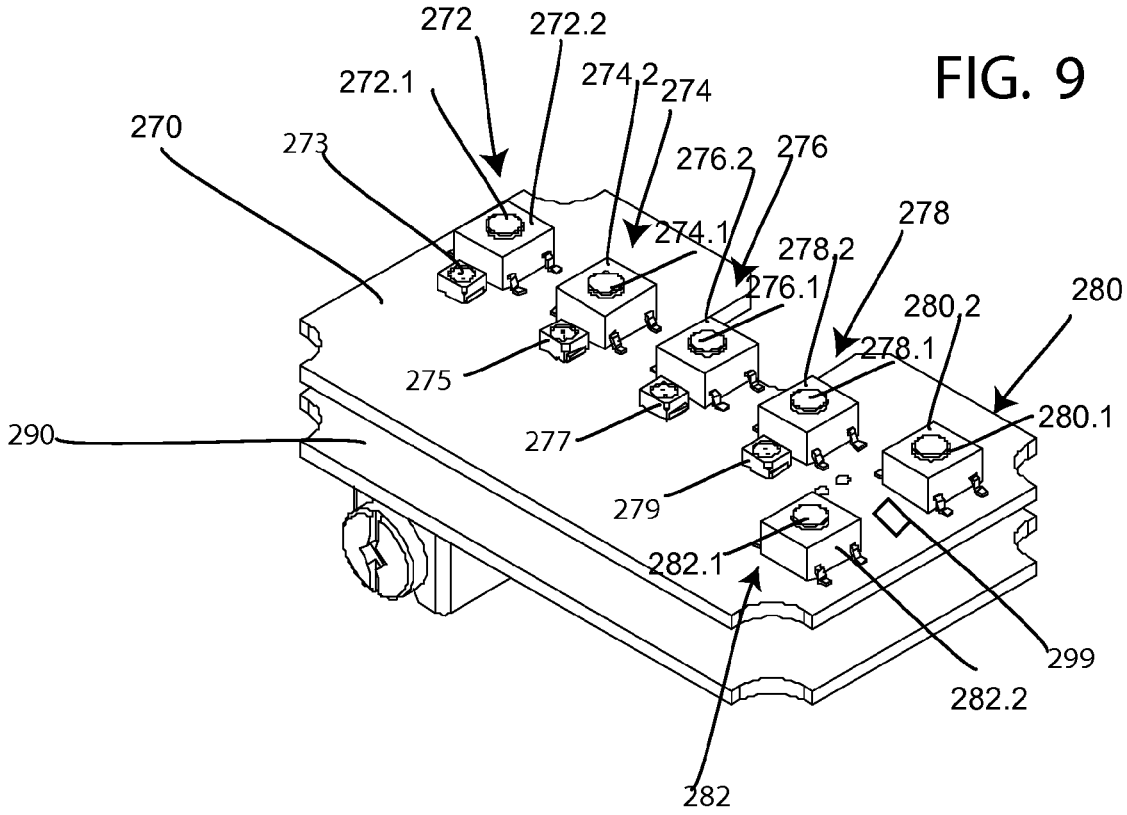
FIG. 9 Is a perspective view of the circuit boards shown in FIG. 6.

FIG. 9 shows a perspective view of circuit boards 270 and 290. Circuit board 270 includes a plurality of switches 272, 274, 276, 278, 280, and 282. Each of these switches includes an associated actuator 272.1, 274.1, 276.1, 278.1, 280.1, and 282.1, wherein each of these actuators are associated with a contact base 272.2, 274.2, 276.2, 278.2, 280.2, and 282.2. These bases are secured to circuit board 270. In addition, plurality of light emitters are also coupled to circuit board 270. For example, there is shown light emitters 273, 275, 277, and 279. These light emitters can be in the form of any known lights, such as an LED type emitter. As discussed above, these associated contact elements such as contact elements 252.4, 262.3 or 264.3 can contact an associated actuator such as 272.1, 274.1, 276.1, 278.1, 280.1 or 282. This type of contact sends a signal into circuit board 270 which includes a set of instructions thereby actuating an associated set of commands which have been programmed to respond to a contact of an associated contact element.

Figure 10A:
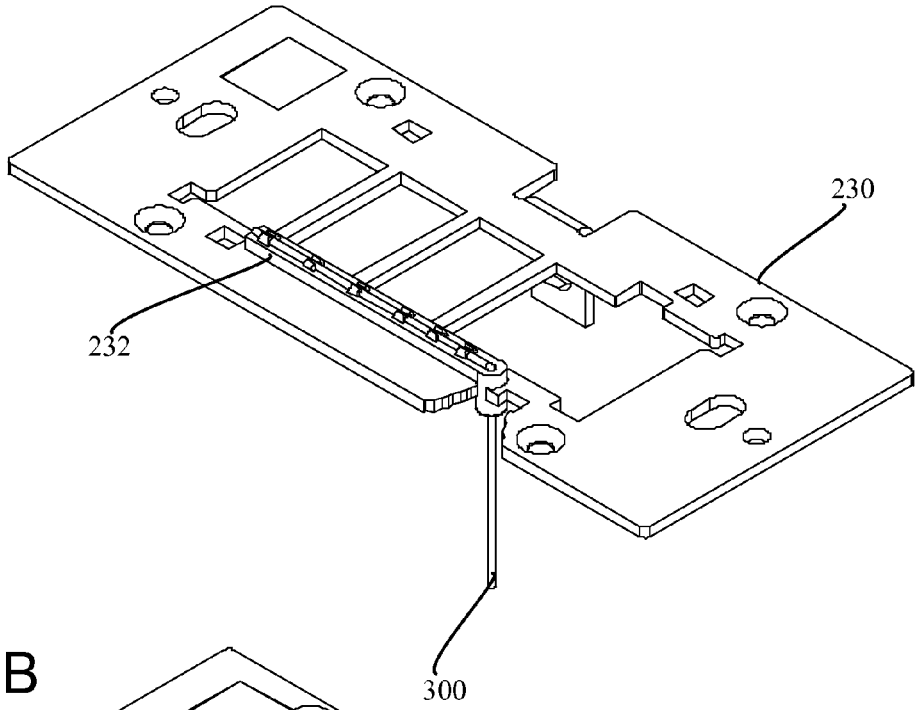
FIG. 10A is a perspective view of the strap and an antenna wire holder as shown in FIG. 6.
Figure 10B:
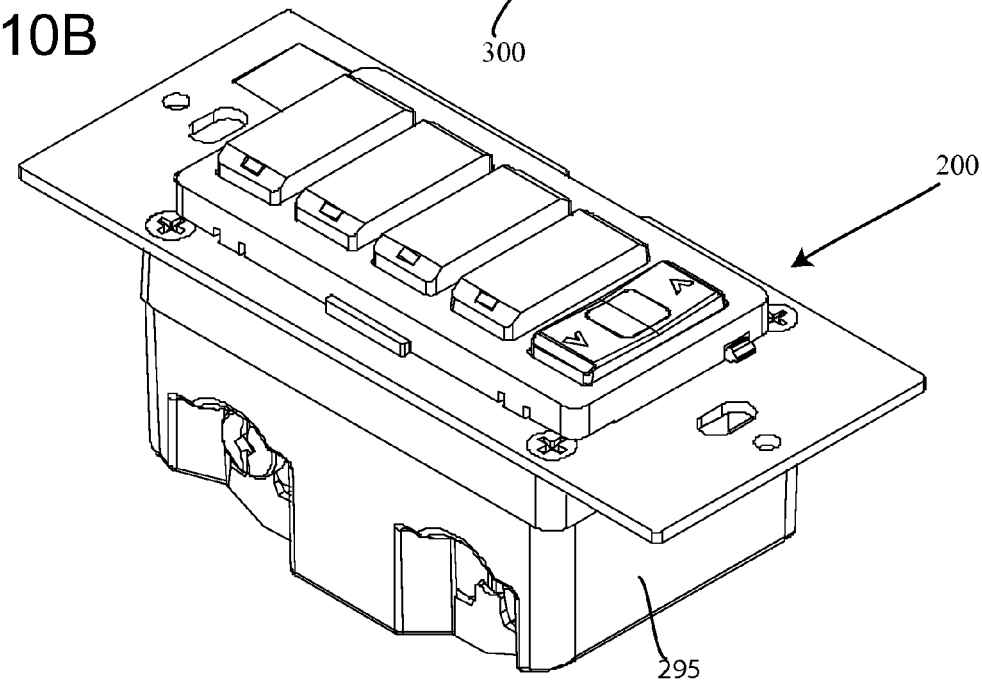
FIG. 10B is a perspective view of the assembled device.

FIG. 10A disclose a perspective view of strap 230 which has an antenna holder 232 coupled thereto. Antenna holder 232 is in the form of a dielectric material which is used to shield antenna 300 from unnecessary effects from a metal strap 230. Antenna 300 is coupled to circuit board 280.

Once this device is fully assembled, antenna 300 is disposed beneath frame 230, but is disposed outside of a housing formed by strap 230 and cover 295. Similar to the first embodiment, frame 210 can be snapped into strap 230, wherein catch 212 can be snapped into snap holes 232.

In addition, frame 210 can be easily removed from strap 230 by simply laterally pressing on frame 210 to release catches 212 (See FIG. 6) from strap holes 232. For example, in this case, a user could use a screwdriver to laterally press on frame 210 and use a flat head of the screwdriver to pull underneath frame 210 to pop it out from strap 230. That user could then replace this frame with a different colored frame to provide a substantially easily adaptable display for a user. This device once assembled can be used as a scene controller wherein each of the push buttons 222, 224, 226, and 228 can be used to set for example, dimmer settings on a light or series of lights in a room. Other uses for these buttons are possible as well.

Both of these embodiments show rocker or push buttons associated with a wireless based system having an antenna and infrared receivers. Both of these embodiments can be used with or without the design of a wireless system disclosed in U.S. patent application Ser. No. 11/559,646, filed on Nov. 14, 2006, the disclosure of which is hereby incorporated herein by reference in its entirety. If the embodiments disclosed in FIGS. 1 and 6 are used with the wireless system of the '646 application, the antenna such as antenna 100 can be a dipole antenna coupled at a first end to a circuit board such as circuit board 270 or 290 inside of a housing formed by cover 295 and strap 230, and extend out of this housing and be coupled to an outside or exterior surface of strap 230. As taught in the '646 application, the antenna can be capacitively coupled to the circuit board.

Alternatively, these embodiments can be incorporated into non wireless systems as well.

With the incorporation of a light into an associated button such as buttons 22, 24, 26, or 28 or buttons 222, 224, 226, or 228, this results in these buttons having an indicator. For example, these lights could be used as nightlights which can be used to guide a user to these buttons. Alternatively, these lights could illuminate when a particular button is pushed. For example, if a push button is pushed in, or a rocker button is rocked towards and activation position, the associated light could illuminate thereby indicating to a user that a particular switch has been activated.

Rocker buttons 22, 24, 26, and 28 and their associated switches on the associated circuit board such as circuit board 80, form rocker switches. These rocker switches can be used as on-off switches, or as level setting switches. For example, if a rocker switch is set as an on-off switch, then a user could for example, push an associated rocker switch to a left position, thereby turning on an electrical load and also turning on an associated light in the button. Alternatively, pushing this switch to a right position would turn an associated load off.

If the rocker switch is a level setting switch, then a push in a particular direction such as to a left position could be used to increase the intensity of power in a load such as increasing a level of a light connected to an associated controller. Alternatively by pushing this rocker switch in an opposite direction, this could be used to reduce the intensity of power to this load.

Alternatively, a push button which is shown by way of example as buttons 222, 224, 226, and 228 and their associated switches which are disposed on circuit board 270 are combined to form push button switches. Each push button switch can be designed as either an on-off switch, or a level setting switch as well. For example, when a user pushes a push button, if that push button is associated with an on-off switch, then a first push will turn that switch to an on position, thereby turning an associated light on, while a second push could be used to turn that switch off. Alternatively, each push button can be associated with a different level as well. For example, a first push button such as push button 222 can be associated with a switch for setting an associated load such as a light at a first level of illumination. A second push button such as push button 224 can be associated with a switch for setting an associated load such as a light at a second level of illumination. When a user pushes that associated push button, the associated level is set and a light associated with that button is turned on.

Buttons 29 and 229 can be used as universal switches. For example, in at least one embodiment, button 29 which is positioned to act on switches 189 and 190 can be used as a level setting switch. In this case, the level setting switch would set the intensity level for all of the loads turned on by their associated switches associated with buttons 22, 24, 26 and 28. Button 229 could also be used in a similar manner with associated switches associated with buttons 222, 224, 226, and 228.

In at least one embodiment, push buttons 222, 224, 226, and 228 are in the form of level setting push buttons, wherein button 229 is in the form of an on off switch turning on or off associated loads which can then be set in terms of intensity by push buttons, 222, 224, 226 and 228.

Different combinations of these push buttons and rocker buttons are possible, and can be used to create a scene controller or a zone controller. As described generally above, a zone controller comprises a plurality of buttons representing switches, wherein each switch is for controlling an associated load. Generally, with a scene controller, a button or plurality of buttons can represent switches for controlling multiple downstream loads.

Accordingly, while a few embodiments of the present invention have been shown and described, it is to be understood that many changes and modifications may be made thereunto without departing from the spirit and scope of the invention as defined in the appended claims.

What is claimed is:

1. An electrical device comprising:

a) a housing;

b) at least one button;

c) at least one support board having a frame;

d) at least one spring board coupled at a first end to said support board and having a second free end;

e) at least one light coupled to said at least one button;

f) a circuit board; and g) at least one spacer to separate said at least one support board from said at least one circuit board;

wherein said at least one button is coupled to said at least one support board, and is biased in a first position by said at least one spring board.

2. The electrical device as in claim 1, wherein said housing is adapted to be installed in a single gang electrical wall box.

3. The electrical device as in claim 1, wherein said at least one button has at least one hinge.

4. The electrical device as in claim 1, wherein said light further comprises at least one light pipe disposed in said housing and coupled to said button.

5. The electrical device as in claim 4, wherein said at least one button has at least one hole for allowing light from said at least one light pipe to flow therethrough.

6. The electrical device as in claim 1, wherein said at least one spring board comprises at least two spring boards each coupled at a first end to said support board and having a second free end, and each having an associated contact, and a plurality of switches coupled to said at least one circuit board, wherein said contact on a first spring board and said contact on a second springboard are each configured to contact an associated switch of said plurality of switches.

7. The electrical device as in claim 6, further comprising at least one light pipe and at least one light emitter coupled to said circuit board, wherein said at least one light pipe is coupled to said at least one light emitter at a first end, and to said at least one button at a second end.

8. The electrical device as in claim 7, wherein said at least one light pipe comprises at least one shaft, and at least one head region, wherein said head region is coupled to said at least one button.

9. The electrical device as in claim 8, wherein said at least one head region comprises at least one actuator section which contacts said at least one spring board when said button is moved into an actuating position.

10. The electrical device as in claim 1, wherein said at least one springboard is formed from a non-metallic material.

11. The electrical device as in claim 6, wherein said at least two springboards each comprise a spring section which is coupled to said at least two spring boards at a first end, and a contact section which is coupled to said spring section and which comprises said contact.

12. The electrical device as in claim 11, wherein said at least one contact section has an end coupled to said spring section and an opposite free end.

13. The electrical device as in claim 12, wherein at least one of said at least two spring boards comprises a curved section wherein when said free end is pressed upon, said curved section bends and compresses thereby causing said free end to move down.

14. The electrical device as in claim 13, wherein said at least one spring board is adapted to allow a shaft of said at least one light pipe to pass therethrough.

15. The electrical device as in claim 1, wherein said at least one spring board has at least one hole for allowing a shaft of said at least one light pipe to pass therethrough.

16. An electrical control device comprising:

a) a housing;

b) a plurality of switches coupled to said housing, wherein at least one switch of said plurality of switches is a rocker switch;

c) at least one support board disposed in said housing;

d) at least one spring board disposed in said housing and connected to said at least one support board, wherein said at least one spring board is configured to support at least one of said plurality of rocker switches;

e) at least one light coupled to said rocker switch;

f) a circuit board; and g) at least one spacer to separate said at least one support board from said at least one circuit board wherein said at least one light comprises a light pipe comprising a shaft and at least two emitting sections.

17. The device as in claim 16, wherein said at least one rocker switch is an on-off switch.

18. The device as in claim 16, wherein said at least one rocker switch varies an intensity of power distributed to a load coupled to said device.

19. The device as in claim 16, wherein said at least one rocker switch is coupled to a plurality of downstream loads.

20. The device as in claim 16, wherein said at least one rocker switch comprises a plurality of rocker switches, wherein each of said plurality of rocker switches is coupled to a different downstream load.

21. The electrical device as in claim 16, wherein said at least one support board has at least one opening and wherein said at least one spring board comprises at least two separate spring boards, coupled to said at least one support board and spaced apart from each other to form an opening which is adapted to allow said shaft of said at least one light pipe to pass therethrough.

22. The electrical device as in claim 21, wherein said light further comprises an actuator section which is configured to contact at least one of said at least two separate spring boards.

23. The electrical device as in claim 16, wherein disposed between said at least two emitting sections is a cut out dividing said at least two emitting sections.

24. The electrical device as in claim 16, wherein said at least one light is configured to fit inside an underside region of said rocker switch.

* * * * *